US005742957A

United States Patent [19]

Vanzant

[11] Patent Number: 5,742,957

[45] Date of Patent: Apr. 28, 1998

[54] PNEUMATIC SIT/STAND ASSISTANCE DEVICE HAVING IMPROVED STABILIZATION FEATURES

[76] Inventor: B. W. Vanzant, 7743 Pimlico, Boerne, Tex. 78006

[21] Appl. No.: 599,142

[22] Filed: Feb. 9, 1996

Related U.S. Application Data

[60] Division of Ser. No. 333,624, Nov. 3, 1994, abandoned, which is a continuation-in-part of Ser. No. 65,561, May 21, 1993, Pat. No. 5,361,433.

[51] Int. Cl.[6] ..... A47C 7/00

[52] U.S. Cl. ..... 5/81.1 R; 5/654; 297/DIG. 3; 297/DIG. 10

[58] Field of Search ..... 5/81.1 R, 654, 5/655.3, 655.9, 657; 254/93 HP; 297/DIG. 3, DIG. 10, 485, 452.41, 250.1, 284.6, 284.1

[56] References Cited

U.S. PATENT DOCUMENTS

| | | | |
|---|---|---|---|
| 3,479,087 | 11/1969 | Burke | 297/DIG. 10 |
| 4,629,162 | 12/1986 | Porché | 254/93 HP |
| 4,905,329 | 3/1990 | Heilner | 5/654 |
| 5,361,433 | 11/1994 | Vanzant | 5/81.1 R |
| 5,375,910 | 12/1994 | Murphy | 297/DIG. 10 |
| 5,398,994 | 3/1995 | Thomas | 297/DIG. 10 |
| 5,505,518 | 4/1996 | Pike | 5/654 |

*Primary Examiner*—Alexander Grosz

*Attorney, Agent, or Firm*—Akin, Gump, Strauss, Hauer & Feld, L.L.P.

[57] ABSTRACT

A pneumatic sit/stand device which is preferably used in assisting an invalid or physically disadvantaged person in rising from, or being seated in, a chair. The sit/stand device includes an inflatable bag having two or more cavities which inflate sequentially to help stabilize the person as he is raised from or lowered into a chair. Rear and side wall cavities inflate first to provide stabilization and push the person forward so that his feet contact the floor. A center cavity then inflates to lift and thrust the person into a standing position. The side walls help prevent the person from tilting or leaning from one side to another as air pressure equalizes the bag. The device can be used alone by the physically disadvantaged person or in conjunction with an attendant whose duty is to assist the person in sitting or standing.

11 Claims, 10 Drawing Sheets

PNEUMATIC SIT/STAND ASSISTANCE DEVICE HAVING IMPROVED STABILIZATION FEATURES

This is a divisional application of Ser. No. 08/333,624 (filed Nov. 3, 1994) now abandoned, which is a C-I-P of Ser. No. 08/065,561 (filed May 21, 1993) now U.S. Pat. No. 5,361,433.

FIELD OF THE INVENTION

The present invention relates generally to an apparatus for use in assisting an invalid or physically disadvantaged person in moving to or from a seated position, and more specifically to a pneumatic sit/stand device using an inflatable bag having cavities which inflate sequentially to provide a stabilizing effect.

DESCRIPTION OF THE RELATED ART

Elderly, invalid, and otherwise physically disadvantaged persons often encounter difficulty in raising themselves from or lowering themselves into a chair. The problem of arising from or sitting in a chair is particularly acute with elderly, invalid or obese persons having weakened arm muscles, and assistance is often required to permit them to rise or sit down. In many instances, the cumulative effect is to bruise the arms of the person being assisted in addition to causing physical and mental discomfort to the person assisting, if such person is available. In cases where no personal assistance is available, mechanical, hydraulic or pneumatic sit/stand devices have been developed. In general, these devices are heavy and once positioned remain stationary.

One type of sit/stand device uses an inflatable bag to raise or lower the person. The inflatable bag type of sit/stand device is particularly advantageous in that it is lightweight, and may be simply constructed of durable, inexpensive materials. Thus, an inflatable bag may be conveniently transported and placed in a chair to help lift a person from the chair. For example, U.S. Pat. No. 3,346,885, issued Oct. 17, 1967 to Merriman describes an inflatable bag used to raise or lower a person from a bathtub.

U.S. Pat. No. 4,629,162 to Porche discloses an inflatable bag apparatus for enabling an invalid or physically handicapped person to rise from or lower into a chair. This lift uses a bag that is wedge-shaped so that inflation of the bag lifts and thrusts the person forward. However, a limitation of this device and method is that the entire bag is inflated at one time, and nothing is provided to stabilize the person and prevent the person from falling to either side. As the person is lifted out of the chair, nothing is provided to ensure that the person does not tilt backwards or lean to one side as air pressure equalizes the bag. In addition, the person is lifted upward prior to being pushed forward to an extent where his feet touch the ground. If the person being lifted is unsteady or lacking in balance, the person may fall to one side or the other, possibly with accompanying injury. Therefore, an improved sit/stand device is desired which stabilizes the person as the person is being raised from or lowered into a chair.

U.S. patent application Ser. No. 08/065,561 titled "Pneumatic Sit/Stand Assistance Device Utilizing Sequential Inflation for Stabilizing Effects" filed May 21, 1993 and issuing on Nov. 8, 1994 as U.S. Pat. No. 5,361,433 discloses a pneumatic sit/stand assistance device which includes two or more cavities, preferably including a center cavity and one or more outer cavities, which utilizes sequential inflation of the cavities for stabilizing effects. This patent discloses that the outer cavities inflate with air first to provide stabilization to the user to prevent the user from tilting or leaning from one side to the other as air pressurizes the bag. The center cavity inflates after the outer cavity has begun inflation to lift the person from the chair. Each of the center cavities and the one or more outer cavities included orifices designed such that the outer cavities inflated with air first, followed by the center cavity. In general, the center cavity began inflation after the one or more outer cavities began inflation, but before the one or more outer cavities were completely inflated. However, it would be greatly desirable for the one or more outer cavities to inflate virtually completely before the center cavity begins inflation to provide even further stabilization to the user. It would further be desirable to provide stabilization to the sit/stand device to prevent the device from lifting from the chair or couch while the device was lifting a user to a standing position. It would further be desirable for the sit/stand device to be able to be used on the middle of a couch. Other types of stabilizing features would also be greatly desired in a sit/stand device to provide greater safety to the user.

SUMMARY OF THE INVENTION

The present invention comprises a pneumatic sit/stand device which is preferably used in assisting an invalid or physically disadvantaged person in rising from, or being seated in a chair. The sit/stand device of the present invention comprises an inflatable bag which has an improved design to provide thrusting and lifting forces sequentially in order to help prevent the person from tilting or leaning from one side to another as air pressure equalizes the bag.

In a first embodiment comprising two internal cavities, the sit/stand device includes a center cavity where the person is seated and an outer cavity. The outer cavity is comprised of side wall portions on either side of the center cavity and a rear portion that provides back support to the person being seated or lifted. An air supply assembly is included comprising an air inlet, tubes, inner partitions, and orifices. The inner partitions are included in the device to form the outside and center cavities. The inlet receives air from a source, and the tubes, partitions, and orifices distribute this air to the outer cavity and then to the center cavity. As the bag is inflated, the side wall portions of the outer cavity inflate to provide sideways stability; the rear portion of the outer cavity provides a thrusting force outward (or forward) which also aids the person in standing; while the center cavity provides a lifting force which helps the person stand. This combination of lifting and thrusting better enables a person to rise from or lower into a chair.

Inner partitions having orifices are configured to form the outer and center cavities and distribute the air from the outer cavity to the center cavity. In this embodiment, a first interior partition divides the rear portion of the outer cavity from the center cavity, and second and third interior partitions divide the side wall portions of the outer cavity from the center cavity. The second and third inner partitions each have an orifice between the respective side wall portion of the outer cavity and the center cavity. Air flow is unrestricted between the rear and side wall portions of the outer cavity, and the orifices allow restricted air flow between the outer cavity and the center cavity. Thus, as the device is inflated, the air flows from the side wall portions of the outer cavity to the center cavity, inflating the rear and side wall portions of the outer cavity before the center cavity is inflated. This sequential inflation provides a stabilizing effect.

In an alternate embodiment, the sit/stand device comprises a center cavity and outer cavity but does not include orifices between the two cavities. In this embodiment, the center cavity is substantially isolated from airflow. Thus, this embodiment provides greater stability in that the outer cavities inflate completely before the center cavity begins inflation. In this embodiment, the outer cavity fills with air first and is substantially inflated before air passes through the material or seams of the inner partitions and into the center cavity. This ensures that the outer cavity is substantially inflated before the center cavity begins inflating, thus providing greater stability.

In another embodiment, the sit/stand device includes orifices having flaps positioned over the orifices. In this embodiment, the outer cavity fills with air first and is substantially inflated before air passes into the center cavity. The flaps prevent and/or reduce air flow into the center cavity during inflation. After the outer cavity is substantially inflated, air enters the center cavity through the flaps covering the orifices as well as through the material and seams of the inner partitions. The flaps allow air to more efficiently leave the center cavity and thus provides easier deflation of the sit/stand device. The flaps also allow the center cavity to deflate more quickly than the outer cavity when the device is being used to lower a person into a seat due to the weight of the person on the center cavity. In one embodiment, Velcro fasteners are used in conjunction with the flaps to maintain the flaps positioned over the orifices.

Another embodiment includes open cell foam pads placed in the outer cavity and optionally in the center cavity to provide additional lifting force in addition to decreasing the volume of air needed. In one embodiment, the open cell foam pads are sculpted to provide a pocket in which the person is cradled while the bag is inflated. An open cell foam pad may be placed in the center cavity and sculpted lower than the two foam pads in the outer cavity to add more stability and enhance the cradling effect of the pocket, which may be likened to a bucket seat.

The sit/stand device of the present invention may be configured with a composite thin platform comprised underneath the sit/stand device. The composite thin platform is preferably strapped to the chair to prevent the sit/stand device from rising from the chair should the user sway or lean to one side. In an alternate embodiment, the composite thin platform comprises arms to provide further stability to the user.

In yet another alternate embodiment, the sit/stand device is preferably used in conjunction with a walker upon which the user leans in sitting or standing up from the chair. The walker is preferably configured with a remote control device wherein when the user places his hands on the walker, the user can operate the remote control device to operate the sit/stand device. This requires the user to lean out to grab the walker as the user is sitting or standing using the device, thus adding a safety element to the device.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
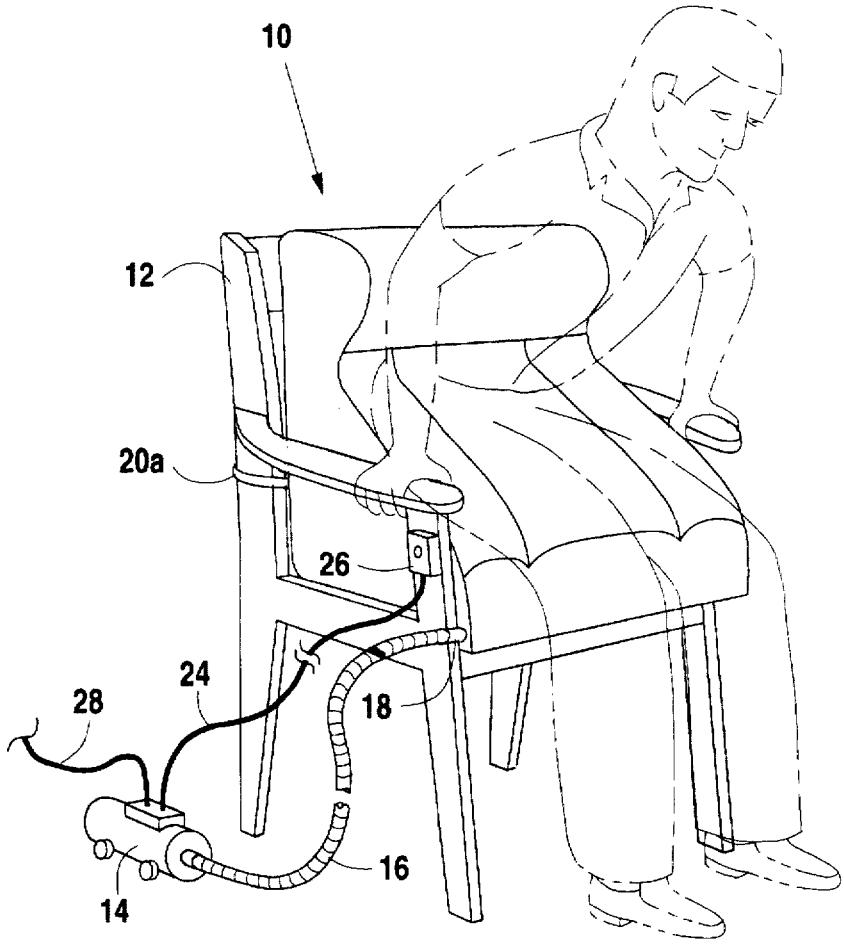
FIG. 1 depicts the sit/stand device of the present invention being used to help a person stand up from a chair.

Referring to FIG. 1, the sit/stand device 10 of the present invention is shown being used to lift a person out of a chair 12. It is noted that the sit stand device 10 of the present invention can be used to either lift a person from a chair or lower a person into a chair. In the following description, the sit/stand device 10 is primarily described as being used in raising a person from a chair. The sit/stand device 10 is intended for elderly, handicapped, obese, invalid or otherwise physically disadvantaged persons who encounter difficulty in rising from or lowering themselves into a chair. The sit/stand device 10 can also be used by people who assist such disadvantaged persons by pulling under their arms, pushing on their backs, etc.

The sit/stand device 10 rests on the seat of the chair 12 and against the back of the chair 12 and is secured to the back of the chair 12 with two straps 20*a* and 20*b* (strap 20*b* not shown). The sit/stand device 10 includes an air supply assembly which includes an air inlet 18 located on the side of the sit/stand device 10 toward the front and below the sitting surface of the chair 12. The air inlet 18 is coupled to an air supply 14 via a hose 16. The air supply 14 is preferably a standard type air inflation device. The air supply 14 also includes a cord 24 connected to a power button 26 on the chair 12 and another cord 28 connected to an electrical outlet (not shown). The power button 26 is used to energize the air supply 14 and is preferably placed near an arm of the chair 12 for ready access by a person in the chair 12.

Figure 2:
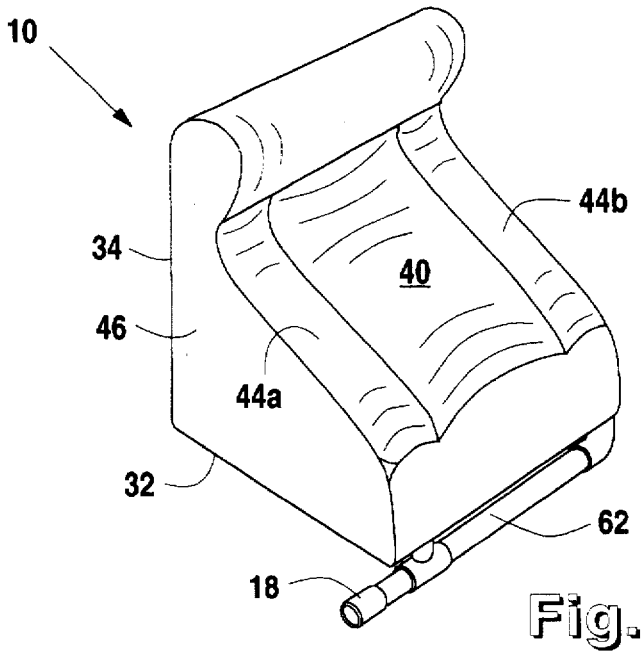
FIG. 2 illustrates the sit/stand device fully inflated.

With reference to FIG. 2, the sit/stand device 10 is shown by itself and inflated. In one embodiment, the device 10 has a manifold 62 which hangs over the edge of the chair 12

(FIG. 1) when the bottom 32 of the device 10 is placed in the chair seat and the back 34 of the device 10 is placed against the chair back. The manifold 62 is used to distribute incoming air from inlet 18 at an equal rate into both side wall cavities 44*a* and 44*b*. In addition to providing air into the device 10, as discussed below, the manifold 62 is provide on the front of the device 10 to position the device 10 relative to the front of the chair 12 as well as ensure that the device 10 is spread across the chair 12 when the device 10 is first placed in the chair 12. This prevents the device 10 from beginning an initial cycle at an improper position in the chair. Also the manifold 62, along with the straps 20*a* and 20*b* (FIG. 1), help to ensure that the device remains in a functional, inflatable position on the chair 12 during sustained use.

Figure 3:
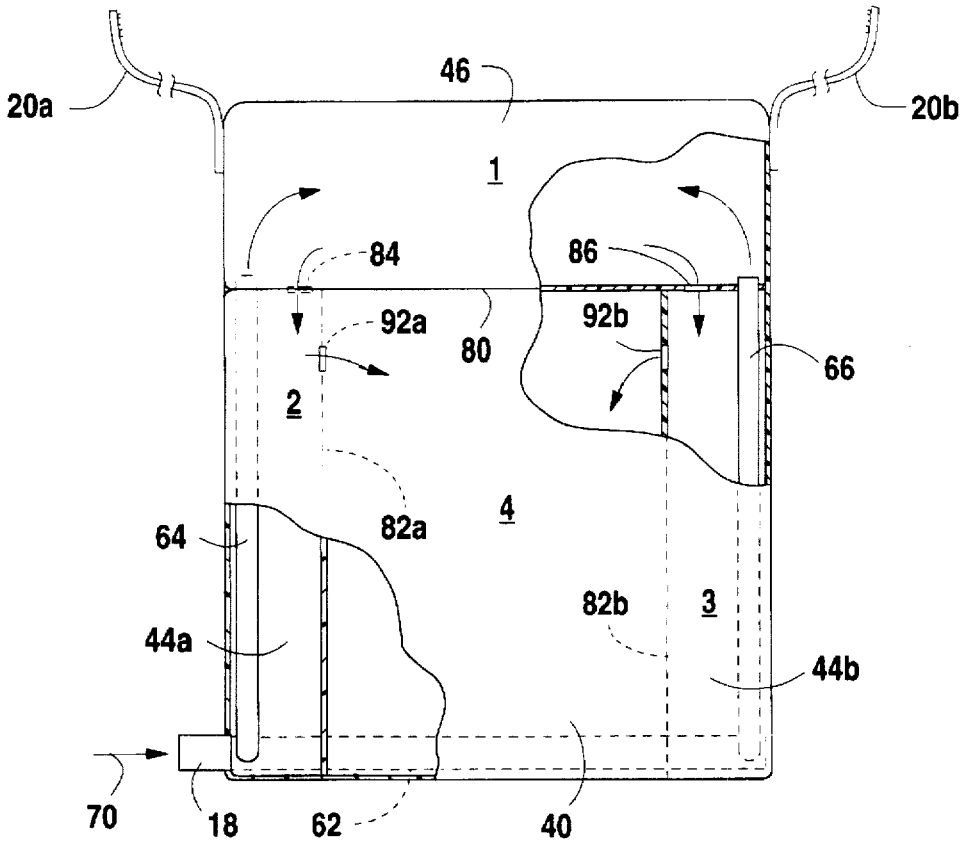
FIG. 3 is a top view of the sit/stand device illustrating air flow according to a first embodiment of the invention having four cavities.
Figure 4:
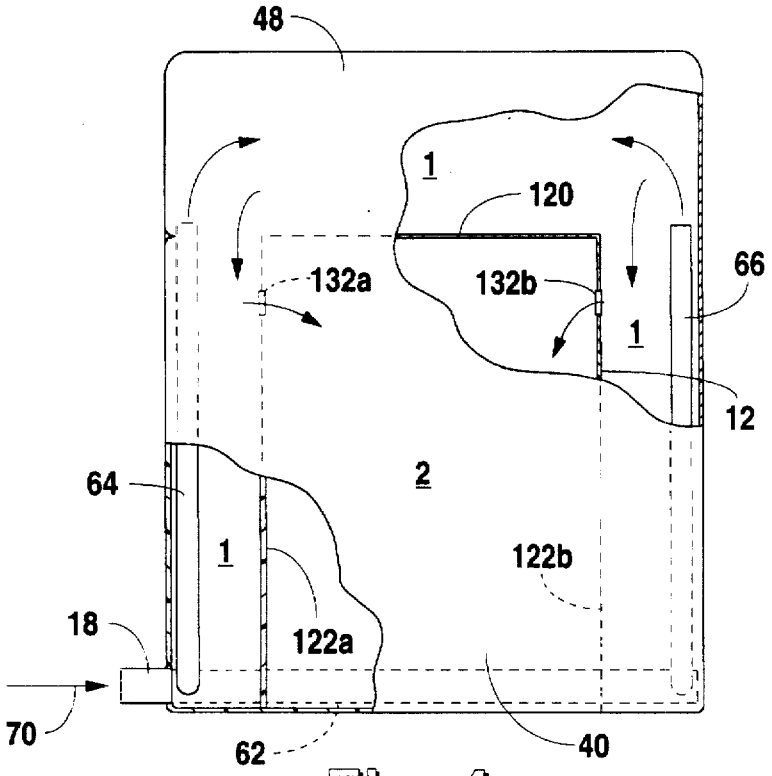
FIG. 4 is a top view of the sit/stand device illustrating air flow according to a second embodiment of the invention having two cavities.

The sit/stand device 10 comprises an inflatable bag that is partitioned into separate cavities. The number, arrangement and configuration of the various cavities are discussed below with regard to FIGS. 3–8. In a four cavity embodiment, as shown in FIG. 3 the device 10 includes a center cavity 40, side wall cavities 44*a* and 44*b*, and a rear cavity 46. In a second embodiment, which has two internal cavities, the rear and side wall portions comprise a single outside cavity which is separate from the center cavity 40, as shown in FIG. 4. As described below, these cavities inflate sequentially to provide stabilization and support as the person is being raised from, or lowered into, a chair. The inflatable bag is preferably made of Regency 70 Denier Nylon.

Referring again to FIGS. 3 and 4, top views of the sit/stand device illustrating the internal components and air distribution according to two different embodiments are shown. In each embodiment, various inner partitions are arranged in the bag to form the cavities. The air inlet 18, tubes and various inner partitions having orifices, which form the air supply assembly, distribute air according to a predetermined sequence.

Figure 5:
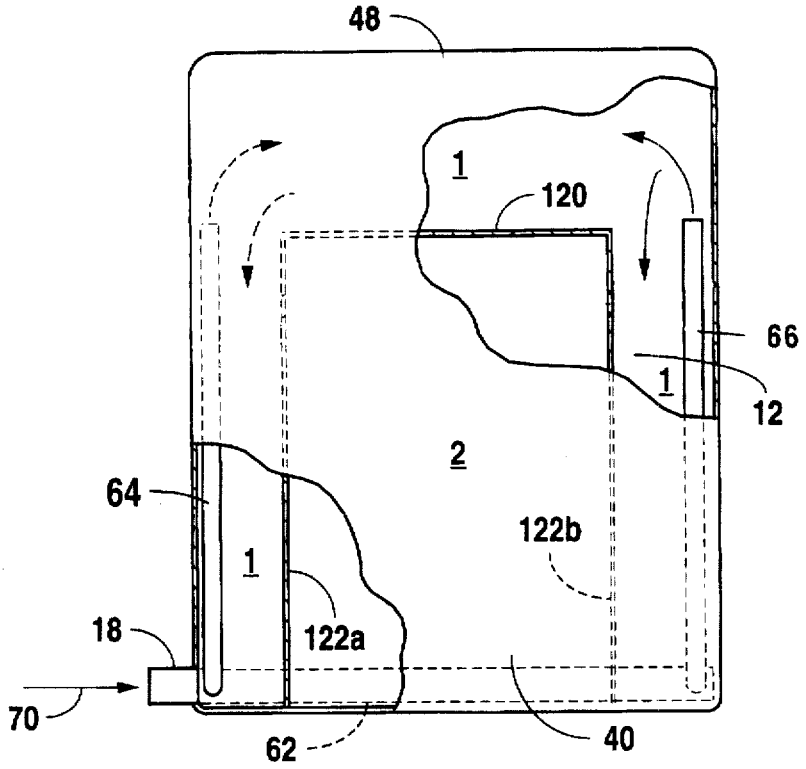
FIG. 5 is a top view of the sit/stand device illustrating air flow according to a third embodiment of the invention having no internal orifices between cavities.
Figure 6:
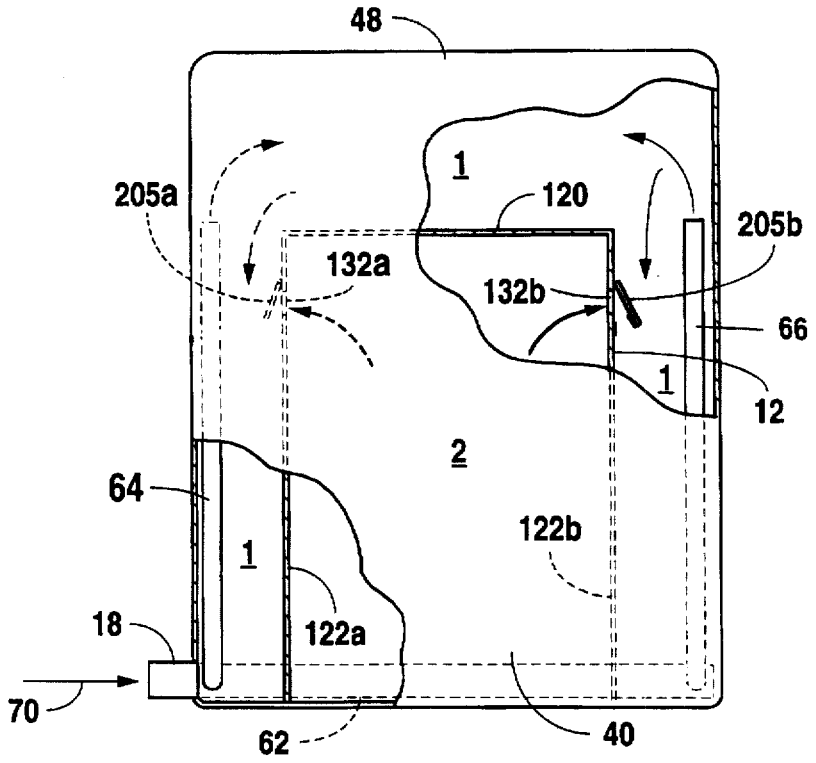
FIG. 6 is a top view of the sit/stand device illustrating air flow according to a fourth embodiment including internal orifices between cavities and including flaps over the center cavity orifices.
Figure 7:
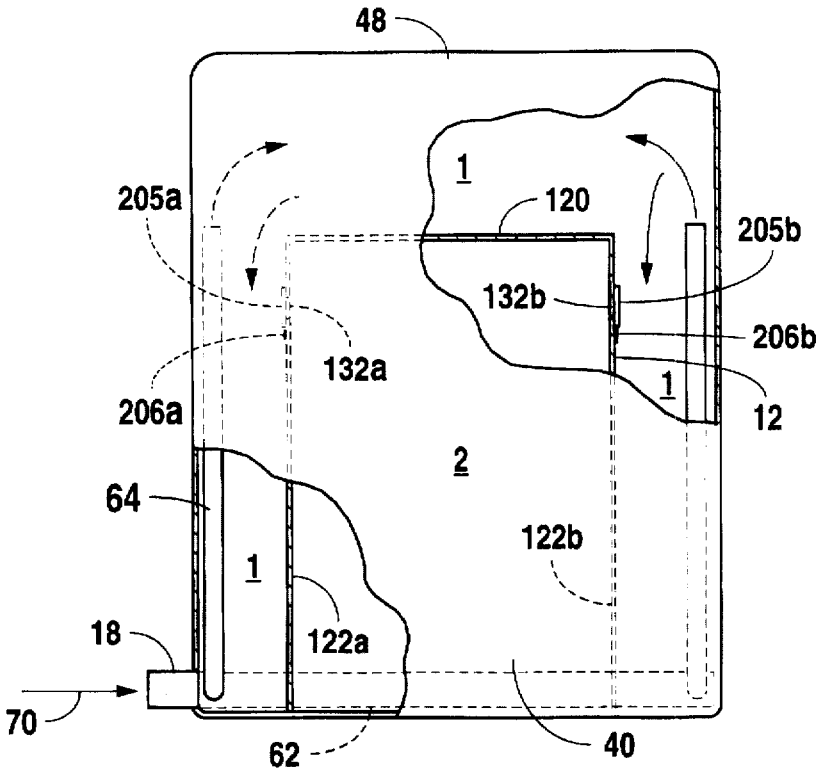
FIG. 7 is a top view of the sit/stand device of FIG. 6 including Velcro fasteners positioned over the flaps.

Air distribution in the bag is preferably such that a person using the device is stable and does not tilt or lean from side to side (wobble) as air pressure equalizes in the bag. Thus, air enters on both sides to provide level rising characteristics. The rear and side wall portions of the bag preferably fill first to provide firmness and stability around the person's buttocks and legs, in essence forming a pocket to cradle the user. To accomplish this, the center cavity may be an island with outer cavities(y) completely surrounding it (not shown), or it may be a peninsula extending inward from the front of the bag as illustrated in FIGS. 3 and 4. In the embodiment shown in FIG. 11, the center cavity is shaped to form a pocket by using contoured open cell foam in the center and side cavities, the foam 206 in the center cavity being less thick than the foam 204 in the side cavities. Alternatively, as shown in FIGS. 5–7, the center cavity 40 receives severely restricted airflow relative to the outer cavity 48 to form a pocket relative to the outer cavity or side cavities. These embodiments are discussed further below. It is noted that the center cavity must rise sufficiently to push the user up to about 20°–30° from the vertical plane so that he/she will be able to lean forward and stand. It is important that the person provide his own impetus to achieve a standing position.

Referring now to the four cavity embodiment in FIG. 3, the device 10 includes an air supply assembly which in this embodiment includes the external inlet 18, external manifold 62, and internal tubes 64 and 66 which direct air 70 to the rear cavity 46 of the device 10. The rear cavity 46 is divided from the center cavity 40 and the side wall cavities 44*a* and 44*b* by an inner partition 80. Each side wall cavity 44*a* and 44*b* is divided from the center cavity 40 by respective inner partitions 82*a* and 82*b*. Inner partition 80 has first and second orifices 84 and 86 between the rear cavity 46 and the side wall cavities 44*a* and 44*b*. Inner partitions 82*a* and 82*b* each have an orifice 92*a* and 92*b* between the side wall cavities 44*a* and 44*b* and center cavity 40. In this embodiment, the orifices 92*a* and 92*b* are located is toward the rear of the side wall cavities 44*a* and 44*b*. Alternatively, the orifices can be moved closer to the front of the side wall cavities 44*a* and 44*b* to alter the inflation of the side wall cavities 44*a* and 44*b* relative to the rear cavity 46. The inner partitions 80, 82*a* and 82*b* are preferably made of the same material as the outer material of the bag comprising the device 10.

The rear cavity 46, side wall cavities 44*a* and 44*b*, and center cavity 40 are labeled 1 through 4, respectively as shown in FIG. 3, and the device inflates generally according to the sequence 1→2,3→4. The tubes 64 and 66 provide the air directly to the rear cavity 46, and thus the rear cavity 46 begins to inflate first. The side wall cavities 44*a* and 44*b*, labeled 2 and 3, begin to inflate soon after the rear cavity 46 begins to inflate. The side wall cavities 44*a* and 44*b* inflate virtually simultaneously. Finally, the center cavity 40 begins to inflate.

FIG. 4 is a top view of the sit/stand device depicting a second arrangement of the air bag. This embodiment comprises an outer cavity 48 including rear and side wall portions and a center cavity 40 forming the center section. As in the previously described embodiment, the device 10 depicted here has an air supply assembly which includes the external inlet 18, external manifold 62 and internal tubes 64 and 66 which direct air 70 to the rear of the device 10. The rear portion of the outer cavity 48 is divided from the center cavity 40 by an inner partition 120. The side wall portions of the outer cavity 48 are divided from the center cavity 40 by inner partitions 122*a* and 122*b* which are in reality extensions of inner partition 120. The center or inner cavity 40 is defined by the inner partitions 120, 122*a* and 122*b*. Inner partitions 122*a* and 122*b* each have an orifice 132*a* and 132*b*, respectively, between the side wall portions of the outer cavity 48 and the center cavity 40. The two orifices 132*a* and 132*b* in FIG. 4 correspond to the orifices 92*a* and 92*b* in FIG. 3. Alternative orifice arrangements (not shown) involve using only one orifice on partition 120 or moving the orifices 132*a* and 132*b* toward the front of the partitions 122*a* and 122*b*.

FIG. 4 also shows details of the air flow path during inflation of the device in this embodiment. Air 70 enters the air supply assembly inlet 18 and is directed through the external manifold 62 and inner tubes 64 and 66 into the rear portion of outer cavity 48. The air then passes through the orifices 132*a* and 132*b* into the center cavity 40. The outer cavity 48 and center cavity 40 are labeled 1 and 2, respectively, and the device 10 inflates according to the sequence 1→2. The person sitting on top of the center cavity 40 helps ensure that the outer cavity 48, rear portion and both side wall portions inflate first.

Sit/Stand Device Without Orifices

FIG. 5 is a top view of a third embodiment of the sit/stand device 10. This embodiment comprises the embodiment of FIG. 4 without the orifices 132*a* and 132*b*. This embodiment comprises an outer cavity 48 including rear and side wall portions and a center cavity 40 forming the center section. As in the previously described embodiment, the device 10 depicted in FIG. 5 has an air supply assembly which includes the external inlet 18, external manifold 62 and internal tubes 64 and 66 which direct air 70 to the rear of the device 10. The rear portion of the outer cavity 48 is divided from the center cavity 40 by an inner partition 120. The side wall portions of the outer cavity 48 are divided from the center cavity 40 by inner partitions 122*a* and 122*b* which are in reality extensions of inner partition 120. The center or inner cavity 40 is defined by the inner partitions 120, 122*a* and 122*b*. Inner partitions 122*a* and 122*b* do not include orifices between the side wall portions of the outer cavity 48 and the center cavity 40.

FIG. 5 also shows details of the air flow path during inflation of the device in this embodiment. Air 70 enters the air supply assembly inlet 18 and is directed through the external manifold 62 and inner tubes 64 and 66 into the rear portion of outer cavity 48. The outer cavity 48 fills with air first and is substantially inflated before air passes or leaks through the material or seams of the inner partitions 120, 122*a* and 122*b* and into the center cavity 40. The outer cavity 48 and center cavity 40 are labeled 1 and 2, respectively, and the device 10 inflates according to the sequence 1→2. The person sitting on top of the center cavity 40 helps ensure that the outer cavity 48 inflates first.

In this embodiment using cavity isolation, the pocket is preferably sized by varying the width of the center cavity. The outer cavity 48 fills decisively before air can leak through the material forming the center cavity 40 and the associated seams holding the material together. This process efficiently provides stability by completely pressurizing the outer cavity 48 thus cradling the person using the sit/stand device 10. When the outer cavity 48 is fully inflated, air leaks into the center cavity 40 to fully inflate the center cavity 40 and lift the user. A disadvantage of this configuration is that depressurization of the center cavity 40 is inefficient and, in fact, in some instances, may not be accomplished until a person sits on the sit/stand device 10 while the air supply is not energized. Another disadvantage is that, when the user sits on the device 10, the outer cavity 48 tends to deflate first, followed by the center cavity 40. This may result in some instability when a person is using the sit/stand device 10 to sit down in a chair. Thus, one problem with the embodiment of FIG. 5 is that when a user sits on the inflated sit/stand device 10 to lower into a chair, air readily evacuates from the outer cavity 48, but air does not readily evacuate from the center cavity 40. This causes possible stability problems because the air pressure in the center cavity 40 is greater than the air pressure in the outer cavity 48, which creates, at least temporarily, a hump or balloon in the middle of the seating area.

Sit/Stand Device Including Orifices and Flaps

FIG. 6 illustrates the embodiment of FIG. 4 including flaps 205*a* and 205*b* over the orifices 132*a* and 132*b*. The flaps 205*a* and 205*b* are designed to prevent and/or reduce air flow into the center cavity 40. FIG. 6 also shows details of the air flow path during inflation of the device in this embodiment. Air 70 enters the air supply assembly inlet 18 and is directed through the external manifold 62 and inner tubes 64 and 66 into the rear portion of outer cavity 48. The outer cavity 48 fills with air first and is substantially inflated before air passes into the center cavity 40. The flaps 205*a* and 205*b* prevent and/or reduce air flow into the center cavity 40 during this time. After the outer cavity 48 is substantially inflated, air enters or leaks into the center cavity 40 through the flaps 205*a* and 205*b* covering orifices 132*a* and 132*b*, as well as through the material and seams of the inner partitions 120, 122*a* and 122*b*. The outer cavity 48 and center cavity 40 are labeled 1 and 2, respectively, and the device 10 inflates according to the sequence 1→2. The person sitting on top of the center cavity 40 helps ensure that the outer cavity 48 inflates first.

Therefore, this embodiment provides flaps 205*a* and 205*b* over the internal orifices 132*a* and 132*b* which impede air from entering the center cavity 40 during inflation. The flaps 205*a* and 205*b*, however, allow air to escape the center cavity 40 through the orifices 132*a* and 132*b* upon deflation. Thus, the sit/stand device 10 may be more efficiently returned to its deflated status. As noted above, the sit/stand device 10 can function properly without orifices, but the deflation time is increased, and may require that a person sit on the inflated center cavity 40 to push the air out of it. Also, the sit/stand device 10 without orifices (FIG. 5) is less stable when used to lower a person into a chair.

Sit/Stand Device Including Orifices, Flaps and Velcro

Figure 8:
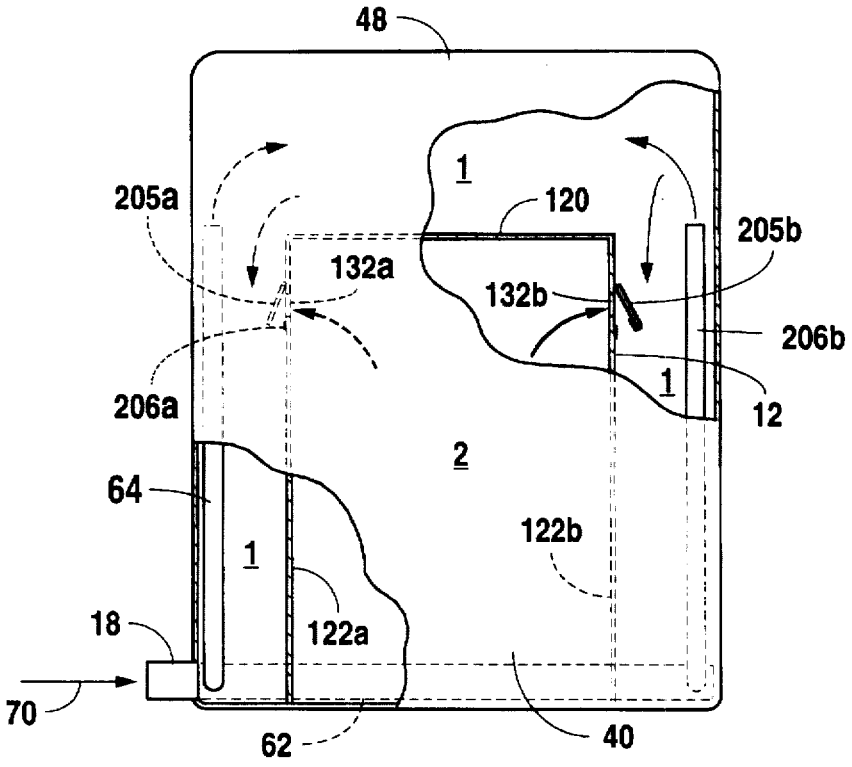
FIG. 8 is a top view of the sit/stand device of FIG. 7 illustrating air flow out of the center cavity through the orifices.

FIG. 7 illustrates the embodiment of FIG. 6 including the flaps 205*a* and 205*b* and including Velcro fasteners 206*a* and 206*b*, respectively, affixed to the flaps 205*a* and 205*b* and to the inner partitions 122*a* and 122*b*. The Velcro fasteners 206*a* and 206*b* ensure that the flaps 205*a* and 205*b* remain properly positioned over the orifices 132*a* and 132*b* after multiple uses. The Velcro fasteners 206*a* and 206*b* help ensure that the flaps 205*a* and 205*b* remain positioned over the orifices 132*a* and 132*b* during inflation so that the outer cavity 48 substantially inflates before the center cavity 40 begins inflation. As shown in FIG. 8, the flaps 205*a* and 205*b* operate as check valves to provide one-way air flow, i.e., air flow out of the orifices 132*a* and 132*b*, when the user sits on the sit/stand device 10 to lower into a chair. This provides more stability when a user is sitting down using the sit/stand device 10 by diminishing the balloon effect mentioned above.

Sequential Inflation—FIGS. 9*a*–9*d*

Figure 9A:
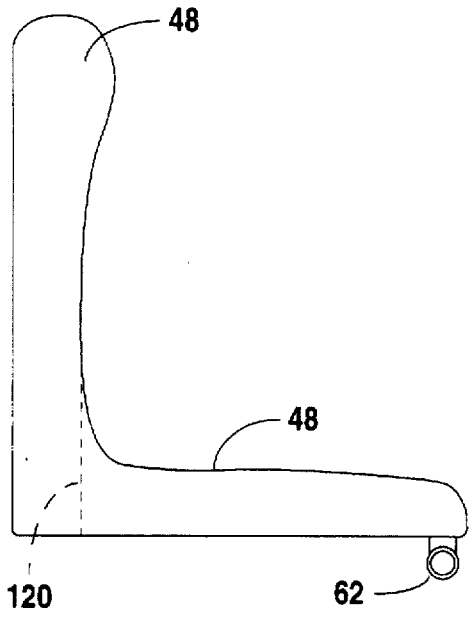
FIGS. 9*a*–9*d* are side views of the sit/stand device alone in various stages of inflation.
Figure 9B:
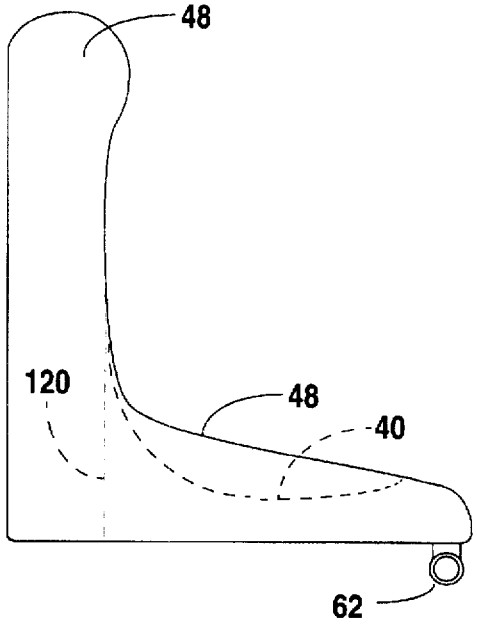

FIGS. 9*a*–9*d* illustrate inflation of the device 10 according to the embodiments of FIGS. 4–7. With reference to FIG. 9*a*, the sit/stand device 10 is shown by itself completely deflated. In FIG. 9*b*, the device is shown partly inflated. In the partly inflated condition, the side wall portions of the outer cavity 48 are more inflated than the center cavity 40. This tends to prevent a person (not shown) sitting on the center cavity 40 from moving sideways. Also, the upper rear portion of the outer cavity 48 is somewhat more inflated, which acts to push the person forward. The center cavity 40 is outlined by the dashed lines and inner partition 120.

Figure 9C:
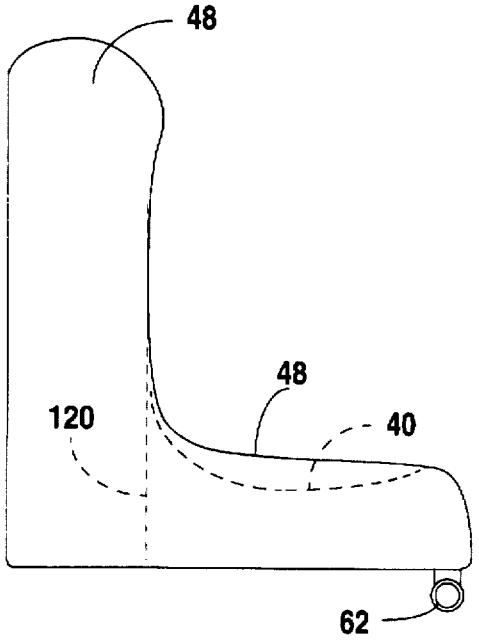

In FIG. 9*c*, the sit/stand device 10 is shown further inflated. In the further inflated condition, the rear portion of the outer cavity 48 provides further forward thrusting of the person (not shown) sitting on the center cavity 40. The side wall portions of the outer cavity 48 are also further inflated. The center cavity 40 by now has begun to inflate to elevate the person from the chair 12. In this further inflated condition, the side wall portions prevent sideward movement of the person sitting on the center cavity 40, and lifting action pushes the person upward. Also, the contoured form of the center cavity 40 serves to push the persons forward to a standing position. Again, in FIG. 9*c*, the dashed lines indicate the form of the center cavity as defined by the top outside surface and the rear inner partition 120.

Figure 9D:
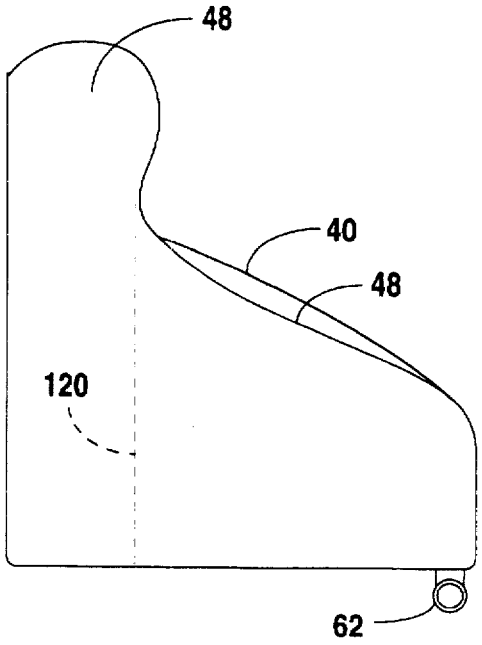

In the completely inflated state as shown in FIG. 9*d*, the upper rear portion of the outer cavity 48 has filled out the limits of its contour to form a convex shape with respect to the side wall portions. The center cavity 40 has fully inflated and is now above the previously inflated side wall portions of the outer cavity 48. In this state, the side wall portions are no longer above the center cavity 40 to restrain sidewards movement of a person (not shown) on the center cavity 40. Also the center cavity 40 has inflated such that the rear of the center cavity 40 is now substantially higher than the front. This is due to the contour of the center cavity 40. Because the rear is above the front at this stage of inflation, additional forward thrusting is provided by the center cavity 40 in addition to its lifting action.

Open Cell Foam Embodiments

Figure 10A:
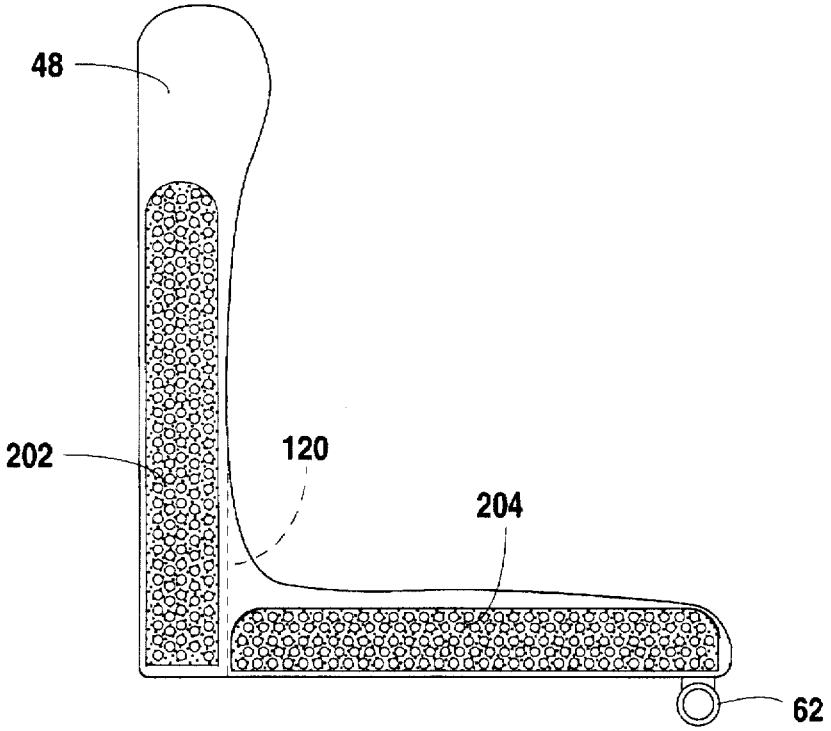
FIGS. 10*a* and 10*b* are side views of the sit/stand device illustrating an alternative embodiment utilizing open cell foam pads.
Figure 10B:
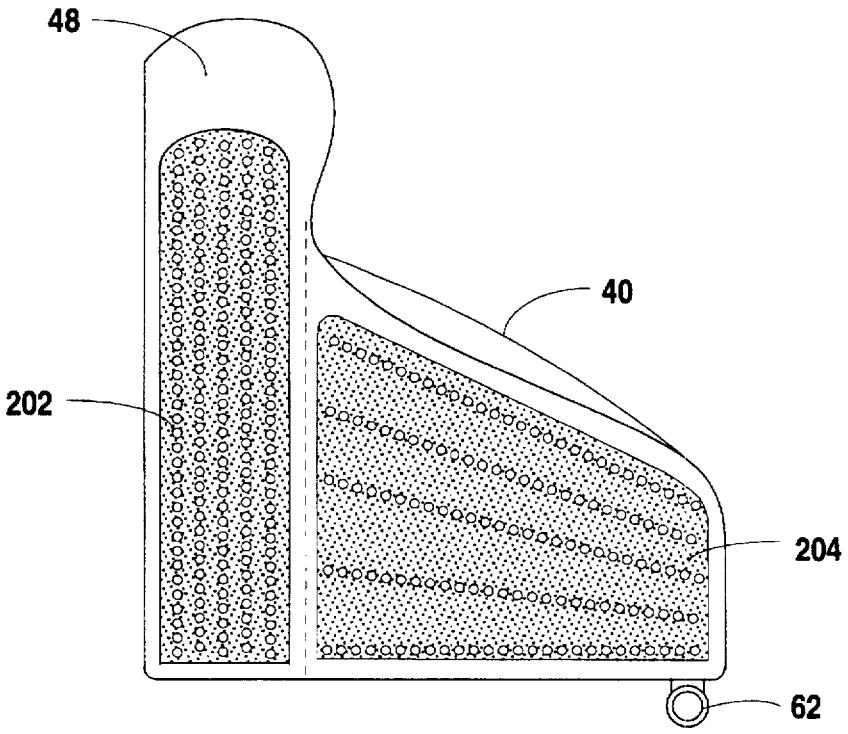

Referring now to FIGS. 10*a* and 10*b*, in an alternate embodiment the sit/stand device 10 includes open cell foam pads 202 and 204 in the outside cavity 48. The use of such internal material provides additional lifting force in addition to decreasing the volume of air needed for full inflation. This not only allows for lower volume of air, but also for lower pressures. Additionally, use of the open cell foam 202 and 204 in the rear and side portions of the external cavity 48 improves stability. FIG. 10*a* shows the device 10 in a collapsed state while FIG. 10*b* shows the device 10 in an inflated state.

Figure 11:
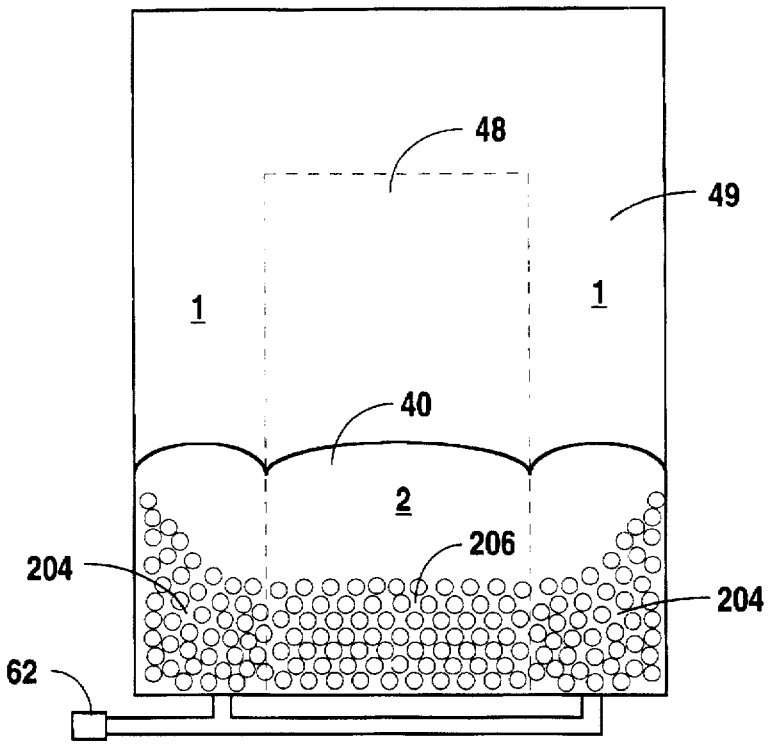
FIG. 11 is a front view of the sit/stand device illustrating an alternative embodiment utilizing contoured open cell foam pads.

FIG. 11 illustrates an embodiment of the sit/stand device including contoured open cell foam pads 204 and 206. In this embodiment, the thickness of the open cell foam pads 204 in the outer cavity 48 is greater than the thickness of the foam pad 206 in the center cavity 40. Any or all of the foam pads 204 and 206 may be contoured, as desired. This provides the effect of a bucket seat and thus adds further stability in conjunction with the other advantages mentioned above.

In each of the above embodiments, to ensure that the user leans forward when using the device 10 to stand, the rear of the device 10 pushes the person forward somewhere close to the shoulder blades before beginning to lift him. For this reason, the device 10 begins to fill from the rear. This pushes the person forward to where his feet are touching the floor prior to any lifting force being applied. This provides further stability.

Thin Platform Embodiments

Figure 12:
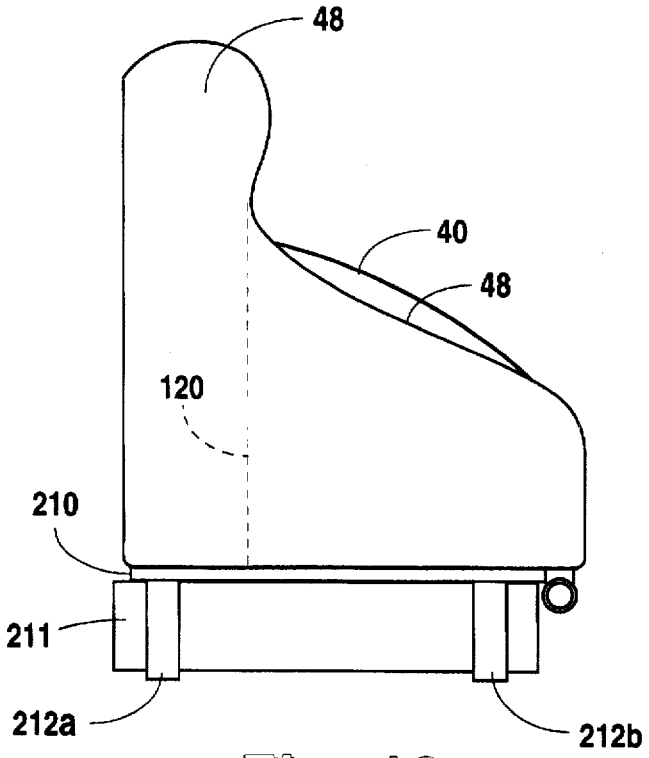
FIG. 12 illustrates a platform which provides a reference plane for the sit/stand device.

FIG. 12 illustrates the sit/stand device 10 used in conjunction with a thin platform 210. The platform 210 is placed on top of a couch or seat cushion 211 and includes straps 212*a* and 212*b* which affix the platform 210 to the cushion 211. This provides greater stability and helps prevent the sit/stand device 10 from tilting or lifting upward from the seating surface 211. Velcro fasteners may be used on the straps 212*a* and 212*b* to enhance the contact of this platform with the cushion.

Figure 13A:
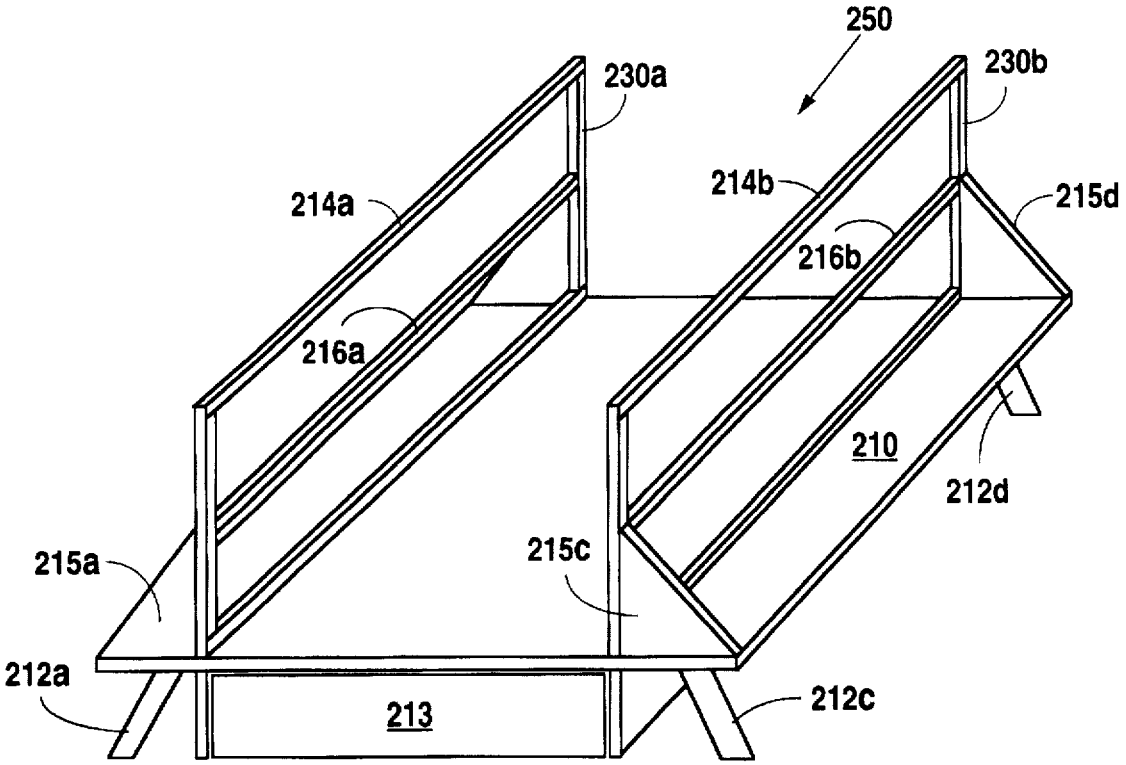
FIGS. 13*a* and 13*b* illustrate perspective and side views of a couch platform for the sit/stand device.
Figure 13B:
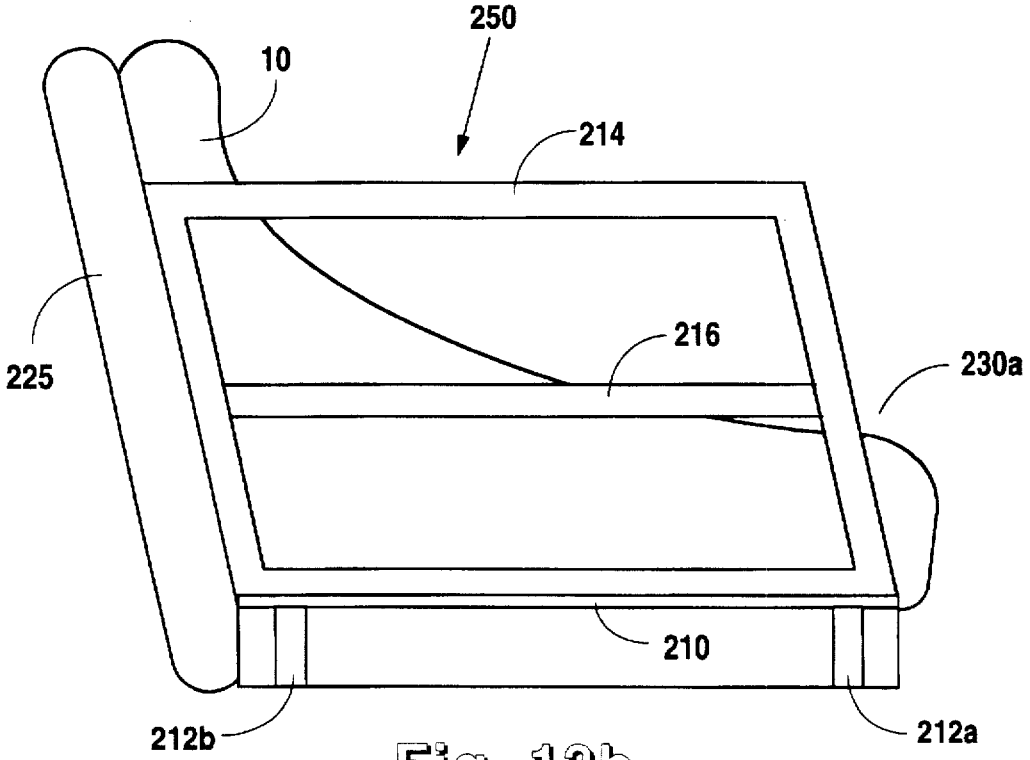

FIGS. 13*a* and 13*b* illustrate an alternate embodiment of a platform assembly 250 which enhances the stability of the sit/stand device 10. As shown in the perspective drawing of FIG. 13*a*, the platform 250 is widened to cover more seating area on a couch than couch cushion 213. The platform assembly 250 is attached by straps 212*a*, 212*b* (not shown), 212*c* and 212*d*. The platform assembly 250 includes two riser arms 230*a* and 230*b* on each side of the cushion 213 which are substantially parallel with each other. These riser arms 230*a*, 230*b* extend below the seating surface to confine the pillow between them; the upper part of these riser arms 230*a*, 230*b* not only confine the user but also provide rails 214*a*, 214*b* for hand grips, thus enhancing stability. To further ensure the stability of the platform 250, it is expedient to provide side rails 216*a*, 216*b* and wedges 215*a*, 215*b* (not shown) 215*c* and 215*d* between the riser arms 230*a*, 230*b* and the portion of the platform 210 extending over adjacent cushions. FIG. 13*b* is a side view of the platform assembly 250 depicted in FIG. 13*a*. The sit/stand device 10 is cradled between riser arms 230*a* and 230*b* (not shown). The arm rest 214*a* and 214*b* provide some stability for the user. Rear couch cushion 225 serves as a back for the device 10.

An alternative embodiment of the platform concept involves increasing the width of the sit/stand device so that the outside cavity 48 provides side stability instead of the riser arms 230*a*, 230*b* shown in FIG. 13. The usual configuration of the sit/stand device is dictated by chair width, so that inflation of the outer cavity 48 is accomplished against some of the weight of the user. If the width of the center cavity 40 is sufficiently large, the outer cavity 48 can be inflated with no user weight restricting inflation, thus achieving some degree of rigidity and stability prior to the inflation and upward thrust of the center cavity 40.

Figure 14A:
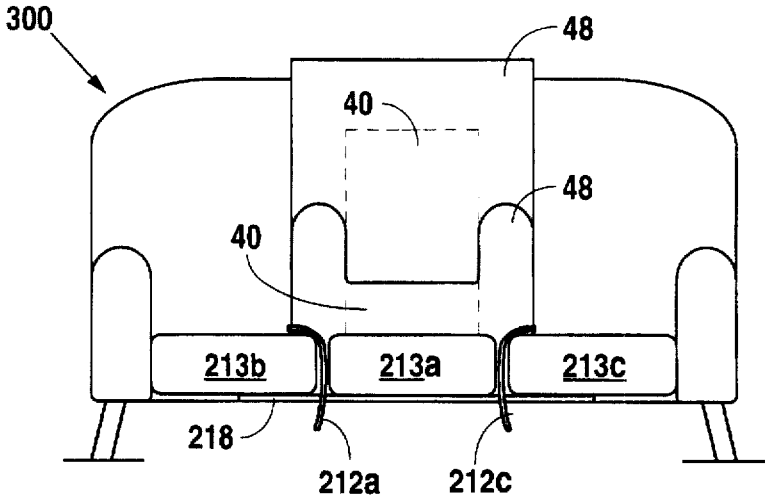
FIGS. 14*a* and 14*b* illustrate an embodiment of a couch platform for the sit/stand device.
Figure 14B:
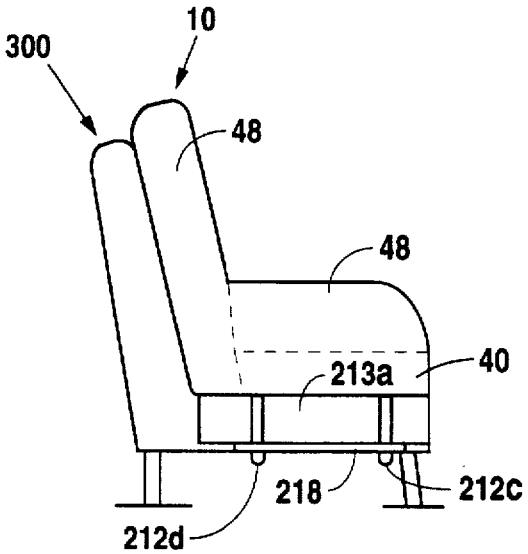
Figure 15:
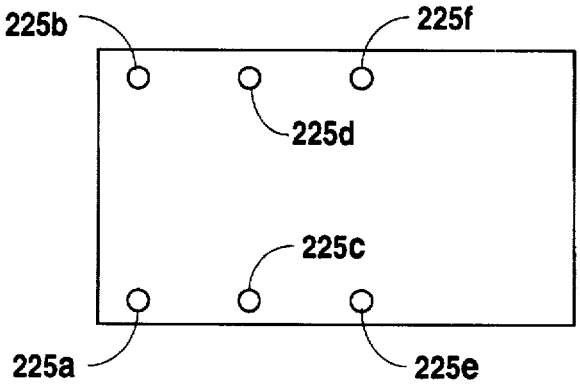
FIG. 15 is a top view of the couch plate of FIGS. 14*a*–*b*.
Figure 16:
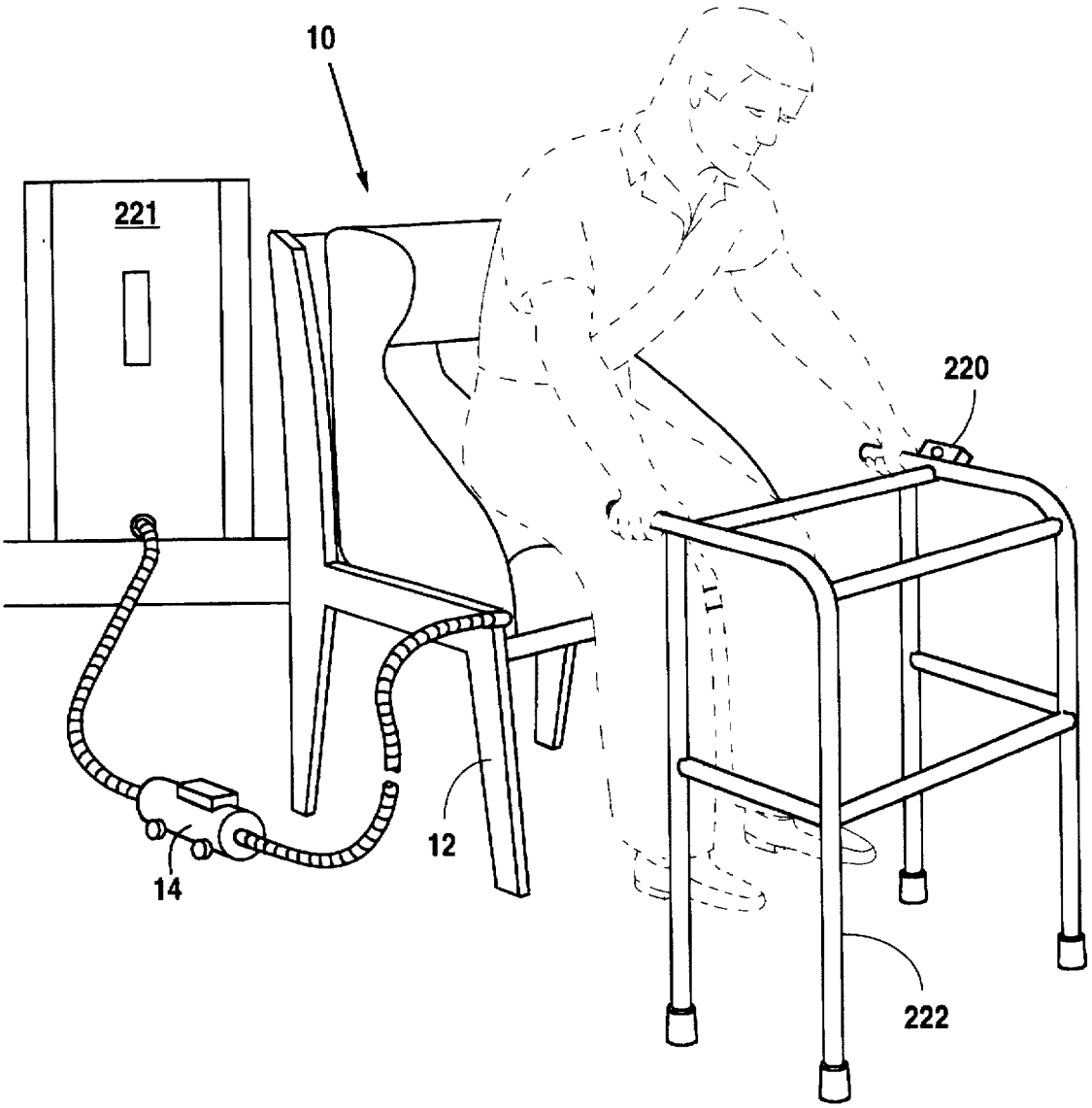
FIG. 16 illustrates the sit/stand device used in conjunction with a walker having a remote control attached to the handle.

Referring now to FIGS. 14*a–b* and 15, if the center cavity 40 is of proper width, the stabilizing platforming 250 may be placed underneath the cushion 213, such that the straps 212*a*, 212*b*, 212*c*, 212*d* may be affixed beneath the cushion 213. FIGS. 14*a–b* illustrate another embodiment for using the sit/stand device 10 with improved stability on a couch 300. The width of the center cavity 40 is increased so that the user does not sit on the side portions of the outer cavity 48. A thin platform 210 (not shown) may be used directly under the device 10, as desired. Straps 212*a*, 212*b* (not shown), 212*c*, 212*d* from the device 10 are passed through slots (described below) in an anchor plate 218 placed under the cushion 213*a*, 213*b*, 213*c*. The length of the anchor plate 218 is such that it extends under the pillows 213*b*, 213*c* which do not directly support the device 10. The device 10 is directly connected to the anchor plate 218 by the straps 212*a–d*, and thus any tilting through slots 225*a–f* (FIG. 15) or uplifting of the device 10 on the couch 300 in a sideways direction is resisted by the friction of the pillow 213*a–c* and anchor 218 arrangement. In this embodiment, the outer cavity 48 is pressurized first and provides side support for the user's arms. If the device 10 is placed on a side cushion 213*b* or 213*c* instead of the center cushion 213*a*, different slots in the anchor plate 218 can be used so that the plate 218 can accommodate any position on the couch 300.

FIG. 15 shows the anchor plate 218 in plan view. The underplate 218 is rectangular in shape and preferably made of a lightweight rigid material. Slots 225*a–f* may be positioned on the anchor plate as dictated by couch dimensions.

Remote Control Walker Embodiment

FIG. 14 illustrates the sit/stand device 10 used in conjunction with a walker 222 which includes a remote control 220 for the sit/stand device 10 mounted on the walker 222. Wall unit 221 provides power to the sit/stand device 10 when the remote control 220 is operated. This configuration serves as a safety precaution in that the user must hold onto the walker 222 before energizing the sit/stand device (not shown) in FIG. 14. Stability is considered to be a function not only of the sit/stand device, but also of the user, who influences the stability of the device.

Conclusion

Thus, an improved sit/stand device is provided which provides stability to the person being lifted. The bag comprising the device is partitioned into two or more separate cavities which inflate sequentially. The rear and side walls of the device inflate first to bring the person's feet in contact with the floor and also prevent sideways movement. The center section begins inflation later after this stabilization has been provided to lift and thrust the person forward into a standing position.

The invention is intended to be limited only as defined in the claims. Additional objects, advantages, and novel features are set forth in the following description, or will be apparent to those skilled in the art or those practicing the invention. Other embodiments are within the spirit and scope of the invention. These objects and embodiments may be achieved by the combinations pointed out in the appended claims.

What is claimed:

1. An air operated inflatable, cushion-like sit/stand device for assisting physically disadvantaged persons in moving to or from a seated position, comprising:

one or more partitions defining a center cavity and an outer cavity, wherein said one or more partitions include orifices allowing passage of air between said center and outer cavities, wherein a person may be seated on the center cavity; and an air supply assembly connected to said outer cavity which provides air to said outer cavity, wherein said outer cavity substantially inflates prior to said center cavity to stabilize the person rising from a seated position.

2. The sit/stand device of claim 1, further comprising:

wherein air leaks from said outer cavity to said center cavity to inflate said center cavity after said outer cavity is substantially inflated.

3. The sit/stand device according to claim 1, wherein the center cavity has front, rear, and opposite sides, and wherein the outer cavity comprises:

side wall portions located on each of the sides of the center cavity and capable of receiving air supplied thereto to retain the person within certain sideways limits of the center cavity during a portion of the lifting distance; and a rear portion connected to the rear of the center cavity and also connected to the side wall portions for supporting the person seated and capable of receiving air supplied thereto to thrust the person forward a certain distance.

4. An air operated inflatable, cushion-like sit/stand device for assisting physically disadvantaged persons in moving to or from a seated position, comprising:

one or more partitions defining a center cavity and an outer cavity, wherein said one or more partitions include one or more orifices allowing passage of air between said center and outer cavities, wherein a person may be seated on the center cavity;

one or more flaps attached to said one or more partitions and positioned over said one or more orifices which limit air flow from said outer cavity to said center cavity; and an air supply assembly connected to said outer cavity which provides air to said outer cavity, wherein said outer cavity substantially inflates prior to said center cavity to stabilize the person rising from a seated position.

5. The sit/stand device of claim 4, further comprising:

hook and loop type fasteners attached to said flaps which maintain said flaps substantially over said one or more orifices.

6. An air operated inflatable, cushion-like sit/stand device for assisting physically disadvantaged persons in moving to or from a seated position, comprising:

one or more partitions defining a center cavity and an outer cavity, wherein a person may be seated on the center cavity;

an air supply assembly connected to said outer cavity which provides air to said outer cavity, wherein said outer cavity inflates generally prior to said center cavity to stabilize the person rising from a seated position; and one or more contoured open cell foam pads comprised within said outer cavity for providing additional lifting force and for decreasing the volume of air required for full inflation.

7. The sit/stand device of claim 6, further comprising an open cell foam pad comprised within said center cavity, wherein said open cell foam pad in said center cavity has a vertical thickness less than the vertical thickness of said one or more open cell foam pads in said outer cavity.

8. An air operated inflatable, cushion-like sit/stand device for assisting physically disadvantaged persons in moving to or from a seated position, comprising:

one or more partitions defining a center cavity and an outer cavity, wherein a person may be seated on the center cavity;

an air supply assembly connected to said outer cavity which provides air to said outer cavity, wherein said outer cavity substantially inflates generally prior to said center cavity to stabilize the person rising from a seated position;

one or more open cell foam pads comprised within said outer cavity for providing additional lifting force and for decreasing the volume of air required for full inflation, wherein said one or more open cell foam pads in said outer cavity have a first thickness; and an open cell foam pad comprised within said center cavity for providing additional lifting force and for decreasing the volume of air required for full inflation, wherein said open cell foam pad in said center cavity has a second thickness less than said first thickness.

9. The sit/stand device of claim 8, wherein the center cavity is capable of expelling air to lower a person a certain distance; and wherein the outer cavity is capable of expelling air to stabilize the person as the person is lowered.

10. An air operated inflatable, cushion-like sit/stand device for assisting physically disadvantaged persons in moving to or from a seated position, comprising:

one or more partitions defining a center cavity and an outer cavity, wherein said one or more partitions include one or more orifices allowing passage of air between said center and outer cavities;

wherein a person may be seated on the center cavity, and wherein the center cavity is capable of receiving air supplied thereto to lift the person upward a certain distance; and wherein the outer cavity is capable of receiving air supplied thereto to stabilize the person as the person is lifted; and an air supply assembly connected to provide air to said outer cavity, wherein said outer cavity inflates generally prior to said center cavity to stabilize the person rising from a seated position.

11. The sit/stand device of claim 10, wherein said air supply directs air first to said outer cavity and said one or more orifices distribute said air to said center cavity.

* * * * *